US006112329A

United States Patent [19]

Freiherr von Korff

[11] Patent Number: 6,112,329

[45] Date of Patent: Sep. 5, 2000

[54] SHIRT WITH COLLAR

[76] Inventor: Michael Freiherr von Korff, Marienburger Strassse 47, D-50968 Köln, Germany

[21] Appl. No.: 09/068,168

[22] PCT Filed: Jul. 19, 1996

[86] PCT No.: PCT/DE96/01321

§ 371 Date: Aug. 26, 1998

§ 102(e) Date: Aug. 26, 1998

[87] PCT Pub. No.: WO97/16081

PCT Pub. Date: May 9, 1997

[30] Foreign Application Priority Data

Nov. 2, 1995 [DE] Germany ..... 195 40 700

[51] Int. Cl.[7] ..... A41B 3/00; A41B 1/00

[52] U.S. Cl. ..... 2/115; 2/116; 2/129; 2/133

[58] Field of Search ..... 2/115, 116, 129, 2/139, 122

[56] References Cited

U.S. PATENT DOCUMENTS

| | | | |
|---|---|---|---|
| 1,599,968 | 9/1926 | Lipman | 2/115 |
| 2,705,806 | 4/1955 | Williamson | 2/115 |
| 3,009,161 | 11/1961 | Lesavoy | 2/129 |
| 4,011,599 | 3/1977 | Chaney et al. | 2/116 |

FOREIGN PATENT DOCUMENTS

| | | | |
|---|---|---|---|
| 183745 | 8/1922 | United Kingdom | 2/115 |

*Primary Examiner*—Gloria M. Hale
*Attorney, Agent, or Firm*—John Lezdey & Assoc

[57] ABSTRACT

The invention relates to a shirt with a collar attached thereto and a left-hand and a right-hand chest blank which close in the chest area with an underlap having buttons and overlap having button-holes. A reinforcement area is provided which is bounded in a substantially triangular manner by three edges; a first edge which is connected to the underlap or the overlap, a second edge connected to the collar and a third edge connected to the chest blank. There is a button or a button hole below the collar and the level with the first edge.

14 Claims, 3 Drawing Sheets

SHIRT WITH COLLAR

FIELD OF THE INVENTION

The invention relates to a shirt according to the generic part of the main claim.

BACKGROUND OF THE INVENTION

With the known shirt of such a kind (GB-A-183 745) the collar is added with its collar part at the upper edge of each of the two chest cuttings. Godet and upper treadle motion, which together constitute the button panel, are closed by the collar part at the top. In the collar part, on the side of the godet a button is positioned, on the side of the upper treadle motion there is a button hole. The respective button is often called a collar-stud.

In the but toned-up state of the button-stud and the button hole to match, the collar part constitutes a ring, whose circumference is the so-called collar size. The shirt is typically worn with a tie.

For most users a shirt will get too tight in the area of the collar in the course of time, may it be in the course of the day, when the neck gets a little bit bigger usually, may it be after several times of washing the shirt, when the material always shrinks slightly, so that the width of the neck gets smaller. Therefore, the desire exists for a more comfortable collar, which adjusts such changes in the desired collar size or permits them at least. Thereby the shirt should possibly be worn with a tie all the same. The collar should have a proper fit independent from the used measure respectively and it should fit the neck in a comfortable but upright manner.

Very often the comfort when wearing a shirt is achieved in such a way that the top button, namely the already mentioned collar-stud, is not buttoned-up. Thereby it is avoided, however, that a feeling of tightness occurs at the neck during the day or in the course of time, but a proper fit of the collar is not achieved in this manner, because the wings of the collar tend to slide downwards and to the side and a clean, closed collar cannot be achieved. This problem can be solved by wearing a tie, but it only remains an emergency measure.

SUMMARY OF THE INVENTION

This is where the invention sets in. It is the task of the invention to further develop the shirt of the above mentioned kind in such a way that the collar adjusts to different collar sizes, whose range of variation may be at some centimeters, for example 2 to 3 cm, guaranteeing a proper fit. By this a comfortable wearing of the shirt is always achieved with a properly fitted collar.

Departing from the shirt of the above mentioned kind this task is solved by the characteristics of the current invention.

Because of the reinforcing area the transfer from the godet or the upper treadle motion is reinforced in a stiffening way to the collar part and it is avoided that the wings of the collar may slide downwards or to the side. Creases, which then may be formed easily below the collar part, when the shirt is worn with an open collar-stud according to the state of the art, do nor occur. The reinforcement rather operates in such a way that the wings of the collar have a proper fit even without a tie and that this results in a closed collar.

By this the reinforcement is constituted in such a way that the area below the collar is not stiffened at all, but it is rather just as flexible as before. In a preferred embodiment the reinforcement area practically does not show optically. It is only reinforced by suitable measures, there is for example a reinforcing interlining in its area and/or double the thickness of the material, of which the shirt is tailored. Based on the choice of the various interlinings a desired reinforcement can be achieved, the reinforcement should be less than the one used usually in the collar area. This does not exclude that stiffening means, such as collar stiffeners, are sewn into the reinforcing area.

The reinforcing area is in one-piece with the godet or the upper treadle motion. It is taken into account when cutting the chest cutting in the shape of an allowance. By this the reinforcing area only has to be connected with the collar as well as the chest cutting along the second edge and only with the chest cutting along the third edge. This occurs by a seam respectively.

In a preferred embodiment there is an interlining in the godet or the upper treadle motion, which is in connection with the interlining of the reinforcing area and which changes into the same in one-piece. Due to the interlining in the parts of the button panel the chest area of the shirt is slightly reinforced and the collar is supported much better by the chest area, so that it is less inclined to tilt forwards. By this the effect of the reinforcing areas is supported. Each shirt has two reinforcing areas, for each chest side there is therefore a reinforcing area. In a preferred embodiment it is chosen only that big that it possibly does not show, for example that it is optically covered by the wings of the collar, which are folded downwards. The two reinforcing areas of a shirt are both embodied in the same way.

In a special preferred embodiment, there is no button or no button hole provided any longer in the collar part, much rather the top button of the button panel and therefore also the top button hole to match is positioned in the godet or upper treadle motion and below the collar part. The arrangement is chosen in such a way that the top button or the button hole to match is at the same height as the first edge, preferably they are positioned in a distance of 20 to 40% of the total length of the first edge, calculated from the transfer of the upper edge of the upper treadle motion or godet in a collar and from there measured downwards.

The shape of the reinforcing area is basically arbitrary, preferably it has the shape of a triangle. Two edges of this triangle result from the limitation of the godet or upper treadle motion on one hand and on the other hand via the transfer between the chest cutting and the collar part, the third edge extends diagonally to the button panel. It starts a few centimeters away, for example 4.5 cm, from the end of the godet or upper treadle motion and extends to the collar part with a length of 6 to 10 cm diagonally. The third edge may extend in a straight line, but it may also be curved.

Preferably, the upper treadle motion and the godet have a constant width along the major part of their total length, they are widened via the respective reinforcing area, namely first below the collar part of the usual width, for example 2 to 4 cm, to about double the width. The seam, by which the godet or upper treadle motion is constituted after folding the cutting, preferably does not extend to the free edge of the godet or upper treadle motion in a parallel manner via the total length any longer, but rather diagonally to the top to the collar part in the area of the reinforcing area, so that the reinforcing area is also embodied.

In a preferred embodiment, the reinforcing area is in rapport with the rest of the cuttings, so that it practically does not show optically in the finished shirt. Even when the reinforcing area is preferably embodied in such a way that additional material is sewn on the chest cutting, it is also possible to reinforce the chest cutting on the reverse, namely on its interior. The last is possible for example with shirts according to the state of the art as a later addition in such a way that an interlining and if possible an additional layer of material are attached on the interior, which then constitute the reinforcing area according to the invention.

Further advantages and characteristics of the invention derive from the other claims as well as the following description of a non-restrictive embodiment of the invention, which is illustrated further with regard to the drawing.

DESCRIPTION OF THE PREFERRED EMBODIMENTS

The production of a chest part for a shirt is known from the figures. The other cuttings, for example for the back parts, the arms etc. are not concerned by the invention. The same applies to the collar, which is essentially embodied according to the state of the art. However, it does not have either a collar-stud nor a corresponding button hole at its collar part.

Figure 1:
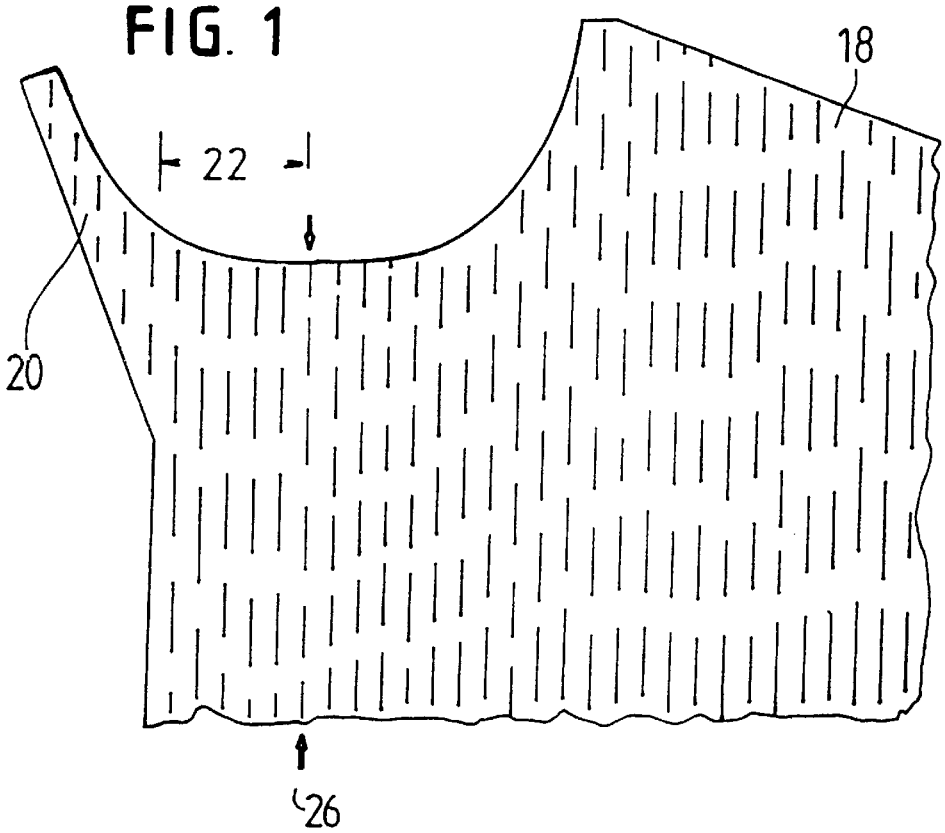
FIG. 1 a top view of the upper area of the chest cutting.

The cutting for a chest area 18 illustrated in FIG. 1 differs from the state of the art only by an additional part 20, which projects as one piece to the top left. An area 22 essentially has (plus the seam allowance) the width of the godet or upper treadle motion to be carried out. The illustrated embodiment refers to the upper treadle motion 24, but also the godet is carried out. In FIG. 1 an arrow 26 marks the position, at which the front edge of the upper treadle motion 24 will be positioned when the cutting is finished. A cotton material, for example, is used with a gsm substance of about 110 g/m$^2$ as a material for the shirt.

Figure 2:
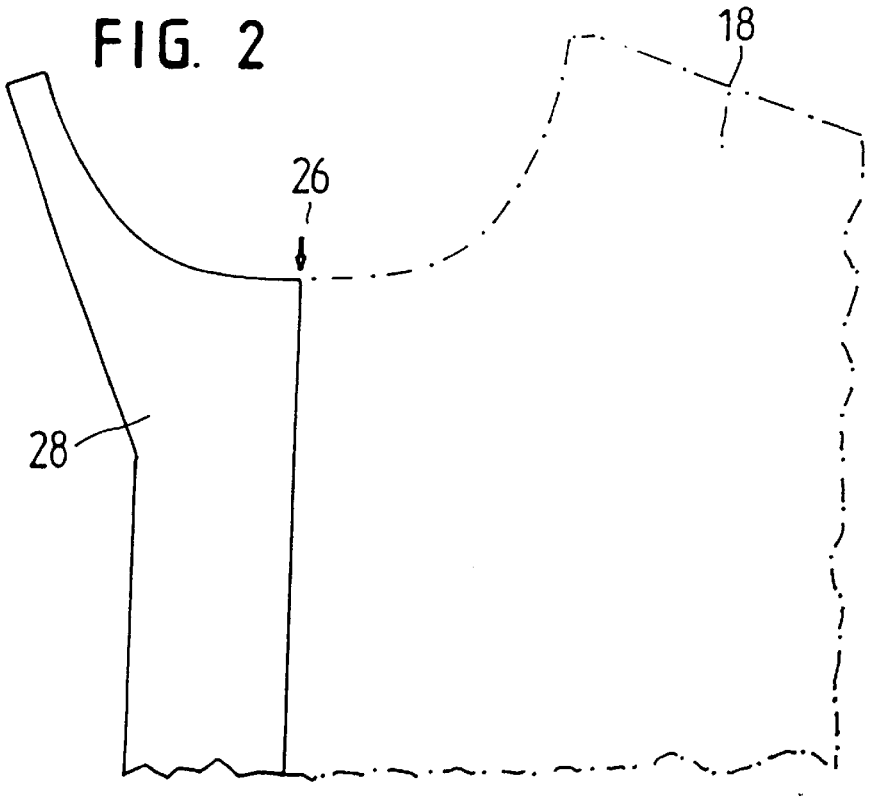
FIG. 2 an illustration according to FIG. 1 of an interlining for the godet or upper treadle motion to be embodied later as well as the reinforcing area, FIG. 3 an illustration according to FIG. 1 for an arrangement, with which the interlining is put on and glued on in this case and where a seam allowance at the left corner of the cutting is folded and then ironed, furthermore a cut has occurred, FIG. 4 an illustration according to FIG. 3 but in this case with a folded godet or upper treadle motion and an embodiment of the reinforcing area, the seams at the front edge and the inside edge of the upper treadle motion or godet as well as along the reinforcing area are already carried out and FIG. 5 the arrangement according to FIG. 4 but in this case only with an attached collar, furthermore button holes are carried out.

As can be seen from FIG. 2, in this case a specially cut piece of interlining 28 is attached to the area 22 and the additional part 20, the interlining 28 has the shape of these two parts 20, 22 and is in one piece. It extends over the entire length of the upper treadle motion 24 and thereby also of the godet, this is not illustrated in the drawing, but it is generally known.

The interlining 28 is fixed onto the material by hot-pressing or by fusing on, as this is generally known. The following material, which are provided with adhesives, are used, for example cotton material with layers of polyethylene, gsm substance between 40 and 120 g/m$^2$, for example 60 g/m$^2$.

Figure 3:
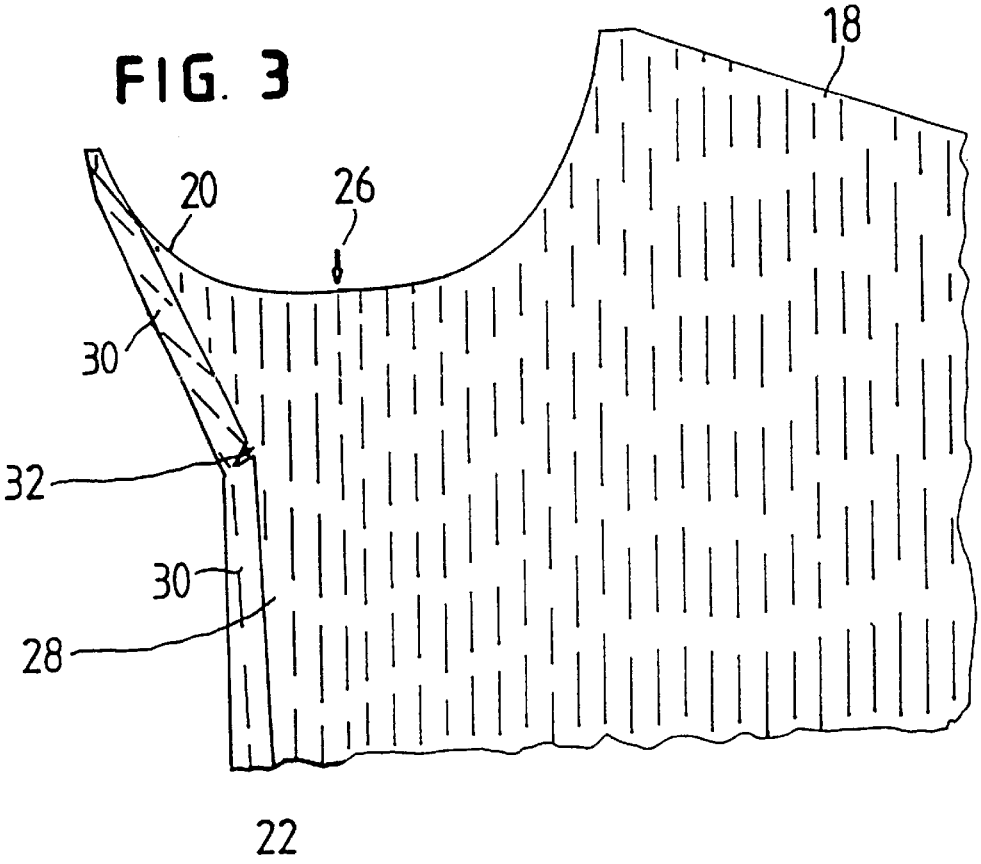

As can be seen from FIG. 3, a stripe 30 of about 1 cm of width is folded over at the left edge of the area 22 or of the additional part 20 as a seam allowance, in the area of a folding, where the left edge of the area 22, which extends in a straight line, changes into the additional area 20, which is limited diagonally to the top, a cut 32 is performed. At this place the reinforcing area starts later extending upwards, this fact will be explained at a later stage. In the manner known already the seam allowance is ironed to make the sewing easier.

Figure 4:
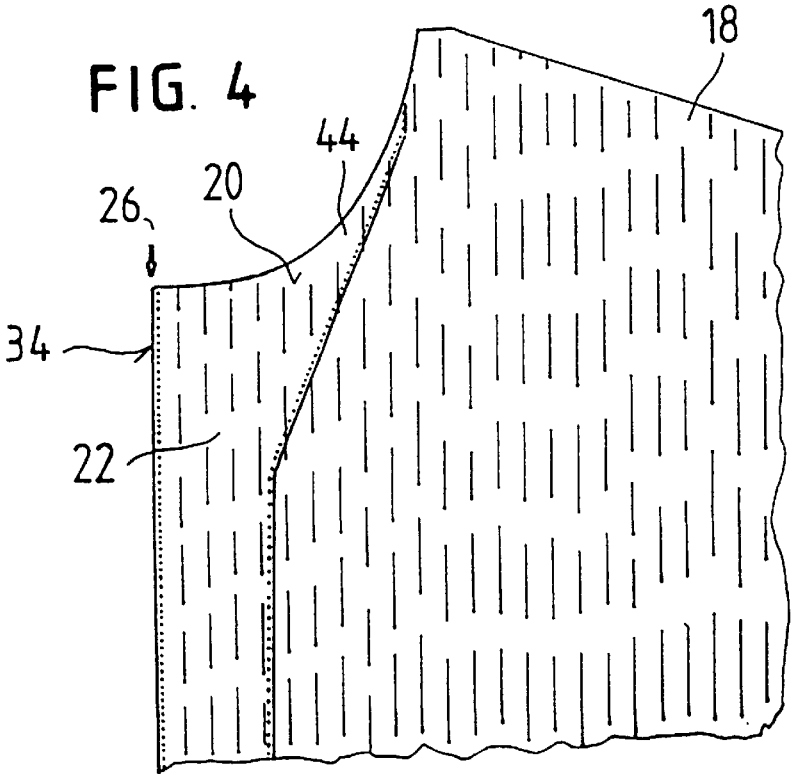

Along the front edge illustrated by the arrow 26 the material is folded and ironed, the produced coating is quilted on in a tight-fitting manner on the right side, the front edge 34, which is positioned on the line of the arrow 26, is topstitched in a tight-fitting manner. By this the arrangement according to FIG. 4 is achieved. It can be recognized, that the right seam of the coating initially extends in the same distance from the front edge 34 as usual seen from below, but that it then projects diagonally to the top in the area of the folding.

Figure 5:
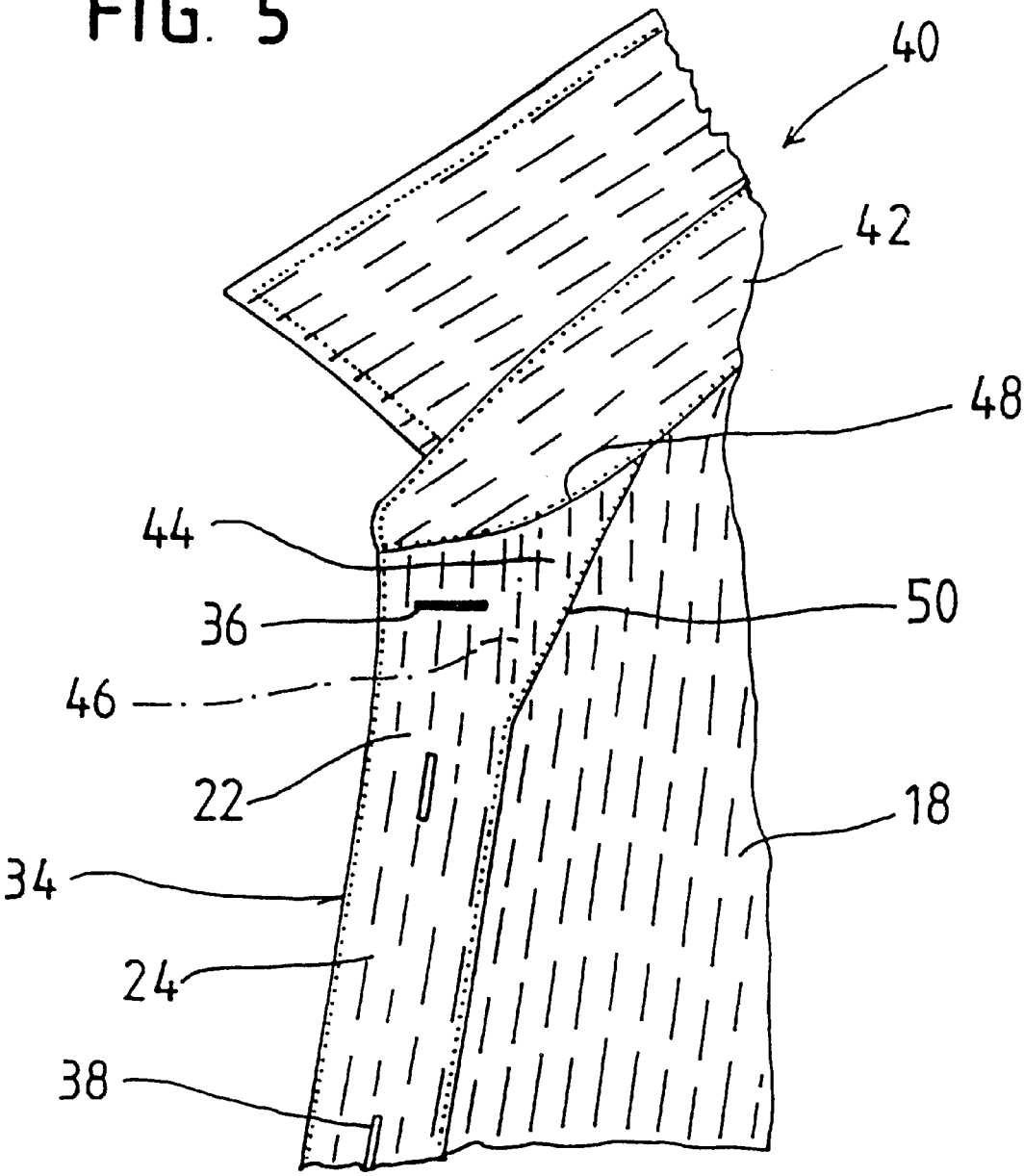

FIG. 5 illustrates the finished arrangement. Button holes are also incorporated into the coating, the upper treadle motion 24 is thereby finished. As can be seen from FIG. 5, the top button hole 36 is positioned in a distance of about 1,5 cm from the upper edge of the upper treadle motion 24. The top button hole 36 extends crosswise to the longitudinal direction of the upper treadle motion 24, the other button holes, of which only the button hole 38 is illustrated, however, extend in the longitudinal direction of the upper treadle motion 24. At the top of the upper treadle motion a collar 40 is sewn on in the manner already known, it has a collar part 42. As can be seen from FIG. 5, there is no button hole provided in the collar, according to this there is no button arranged at the other end of the collar part. The top button of the button panel, which is constituted by the upper treadle motion and the godet, is much rather positioned in a certain distance of the connecting position of the upper treadle motion 34 (or the godet) and the collar part 42.

The finished reinforcing area 44 is illustrated in FIG. 5. Essentially, it has the shape of a triangle. It is limited by a first edge 46, it extends in a presumed extension of the seam with which the coating is topstitched, if the same is extended over the folding in a straight line. The reinforcing area is connected in one piece with the material of the godet 24 along the first edge 46, the same applies to the interlining 28. The reinforcing area is connected with the collar 40, expressed more precisely with the collar part 42, along a second edge 48. A third edge 50 extends diagonally to the front edge 34 and joins the collar part at about a position, which is typically in a distance of double the front edge 34 as this is normally the case with the shirt according to the state of the art. In the illustrated embodiment, the third edge 50 extends in a straight line and it has a length of about 7,5 cm. The width of the upper treadle motion 24 is about 3,5 cm.

The embodiment according to the invention of the reinforcing area 44 is suitable for buttoned down collars, as they are also simply called "button down".

What is claimed is:

1. A shirt comprising a collar, a left chest cutting and a right chest cutting, one said chest cutting finishing in the chest area with an underlap, said underlap having a plurality of buttons, the other said chest cutting finishing with an overlap, said overlap having a plurality of button holes, wherein one of said button holes of said overlap constitutes a top button hole, said shirt further comprising two reinforcing areas, said reinforcing areas each being in the shape of triangles having first edges, second edges and third edges, wherein, one of said first edges connects with said underlap and another of said first edges connects with said overlap, and said second edges connect with said collar, said shirt further comprising a top button and a top button hole, wherein said top button and said top button hole are positioned below said collar at the same height as said first edges, wherein said reinforcing areas are connected with said left chest cutting and said right chest cutting at the respective said third edges, and wherein said reinforcing areas are connected in one-piece with the respective said underlap and said overlap.

2. A shirt according to claim 1 further comprising two interlinings, one said interlining positioned in each of said reinforcing areas.

3. A shirt according to claim 2 wherein each said interlining is positioned respectively in said underlap and said overlap and wherein said respective underlap and overlap is in one-piece with said interlining of one of the respective said reinforcing areas.

4. A shirt according to claim 1 wherein said second edges are connected with said collar by a seam and wherein said third edges are connected with said chest cutting by a seam.

5. A shirt according to claim 1 wherein said collar has a collar part and wherein said button and button hole at the top of said first edges are the top button hole and top button of said plurality of button and button holes.

6. A shirt according to claim 1 wherein said overlap and said underlap respectively are encompassed and closed at the top by said collar part.

7. A shirt according to claim 1 wherein said collar has wings wherein said two reinforcing areas are completely covered under said wings of the collar when said wings are folded down.

8. A shirt according to claim 1 wherein said third edges are bow-shaped.

9. A shirt according to claim 1 wherein said third edges are longer than said first edges and longer than said second edges.

10. A shirt according to claim 1 wherein said second edges are shorter than said first edges and shorter than said second edges.

11. A shirt according to claim 1 wherein said top button and said top button hole are arranged at a height of 20 to 40% of the total length of said first edges, calculated from the top downwards.

12. A shirt according to claim 1 wherein said top button hole extends crosswise to the longitudinal direction of said overlap.

13. A shirt according to claim 1 wherein said reinforcing areas are identical and symmetrically arranged.

14. A shirt comprising a collar and a left hand chest blank and a right hand chest blank which close in the chest area with an underlap on one blank having buttons and an overlap on the other blank having button holes, said shirt having a reinforcement area bounded in a substantially triangular manner by three edges, a first edge being connected to said overlap or underlap, a second edge being connected to said collar by a seam and a third edge being connected to the chest cutting to match by a seam, one of said chest blank having a button below the collar and level with said first edge.

* * * * *